US007237412B1

(12) United States Patent
Huang

(10) Patent No.: US 7,237,412 B1
(45) Date of Patent: Jul. 3, 2007

(54) ALL PURPOSE TYPE DEADBOLT LOCK

(75) Inventor: Chien-Ying Huang, Taichung (TW)

(73) Assignee: SOCA Technology Co., Ltd., Taichung (TW)

( * ) Notice: Subject to any disclaimer, the term of this patent is extended or adjusted under 35 U.S.C. 154(b) by 0 days.

(21) Appl. No.: 11/130,050

(22) Filed: May 17, 2005

(51) Int. Cl.
*E05B 47/00* (2006.01)

(52) U.S. Cl. ..... 70/279.1; 70/277; 70/280; 292/144; 292/251.5

(58) Field of Classification Search ..... 70/276, 70/277, 278.7, 279.1, 280, 281, 282, 257; 292/251.5, 144, 244, 163, 201, 333, DIG. 65
See application file for complete search history.

(56) References Cited

U.S. PATENT DOCUMENTS 1,946,384 A * 2/1934 Baril et al. ..... 70/280
4,099,752 A * 7/1978 Geringer ..... 70/279.1
4,557,121 A * 12/1985 Charlton ..... 70/279.1
4,691,542 A * 9/1987 Young ..... 70/280
4,881,766 A * 11/1989 Schmidt et al. ..... 70/279.1
5,511,832 A * 4/1996 Kunzel ..... 292/144
5,799,518 A * 9/1998 Du ..... 70/281
6,079,755 A * 6/2000 Chang ..... 292/144
2002/0135188 A1* 9/2002 Chang ..... 292/144
2004/0207210 A1* 10/2004 Luker ..... 292/144
2005/0183480 A1* 8/2005 Hingston et al. ..... 70/279.1

* cited by examiner

*Primary Examiner*—Brian E. Glessner
*Assistant Examiner*—Christopher Boswell

(57) ABSTRACT

A magnetic lock comprises an actuation portion; a positioning seat having a slot at a rear end thereof for receiving the actuation portion and a circuit board; a tongue embedded at the slot at the lower end of the positioning seat and being fixed to the connecting sheet; the tongue being movable within the positioning seat; a retaining seat having a displace unit; a core embedded into the slot of the retaining seat and to combine with the displace unit; thereby the movable post, driving sheet, connecting sheet and tongue being interconnected. The magnetic lock is suitable for doors of various specifications. Furthermore, the magnetic lock has an open mode in power-on state and a close-mode in power-off state. Moreover, a pin serves to achieve the object of function setting modes. The magnetic lock has the functions of a mechanical lock and an electronic lock.

6 Claims, 10 Drawing Sheets

ALL PURPOSE TYPE DEADBOLT LOCK

BACKGROUND OF THE INVENTION

The present invention relates to locks, and particularly to a magnetic lock which is suitable for doors of various specifications. Furthermore, the magnetic lock of the present invention has an open mode operated in power-on state and a close mode operated in power-off state. Moreover, a pin serves to achieve the object of function setting. The magnetic lock of the present invention has the function of a mechanical lock and an electronic lock. The structure of the magnetic lock is simple and easy in maintenance with a longer lifetime and lower manufacturing cost.

FIELD OF THE INVENTION

The prior art mechanical locks have complicated structures and thus the assembly works are also tedious so as to be labor-inefficient and not economical. Thereby electronic locks are developed to resolve the defects in the prior art. However the electronic locks still have the following defects. The prior art electronic locks cannot suit for doors of different widths. Thus various kinds of locks are designs for different doors. Furthermore, the prior art electronic locks only have the operation mode of opening as power is off and the opening mode as power is on so that the use of the lock is confined. Moreover, the prior art electronic locks cannot be used as a mechanic locks. When the electronic elements of the electronic lock are destroyed, the lock cannot be used. Furthermore, the prior art electronic locks have some disadvantages which are necessary to be improved.

SUMMARY OF THE INVENTION

Accordingly, the primary object of the present invention is to provide a magnetic lock, wherein the magnetic lock of the present invention is suitable for doors of various specifications. Furthermore, the magnetic lock of the present invention has an open mode in power-on state and a close mode in power-off state. Moreover, a pin serves to achieve the object of function setting. The magnetic lock of the present invention has the function of mechanical lock and electronic lock. The structure of the magnetic lock is simple and easy in maintenance with a longer lifetime and lower manufacturing cost.

To achieve the above object, the present invention provides an actuation portion formed by a magnetic tube, a movable post, a spring, a driving sheet and a connecting sheet; the magnetic tube being received with the movable post therein; a front end of the movable post being engaged to the spring; a front end of the movable post being formed with a slot for receiving a retaining hole of the driving sheet; the movable post being pivoted to the driving sheet by using a pin; the driving sheet being further extended with a first sub-section and the second sub-section which being formed with retaining holes, respectively. The first sub-section and the second sub-section being studded to first end and the second end of the connecting sheet, respectively; interiors of the first end and the second end being threaded for screwing the outer threads of the pin; the connecting sheet having a retaining hole; the connecting sheet further having the third end; a positioning seat having a slot at a rear end thereof for receiving the actuation portion and a circuit board; a slot being formed at a lower end of the positioning seat; an exterior of the positioning seat being formed with two via holes and a positioning hole for receiving a pin; the via holes being corresponding to the retaining holes of the driving sheet; the positioning seat being fixed to the retaining hole; a tongue embedded at the slot at the lower end of the positioning seat and being fixed to the third end of the connecting sheet; the tongue being movable within the positioning seat; a retaining seat having a displace unit; when the displace unit passes through a distal end of the movable post, the displace unit being clamped in the slot of the movable post by using a retaining ring for preventing the displace unit from falling out as the movable post moves; the movable post being movable in the retaining seat; the retaining seat having a slot; a core embedded into the slot of the retaining seat and to combine with the displace unit; thereby the movable post, driving sheet, connecting sheet and tongue being interconnected; a connecting plate; the positioning seat and the retaining seat being locked to the connecting plate; the connecting plate having a via hole; and a casing.

The various objects and advantages of the present invention will be more readily understood from the following detailed description when reading in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
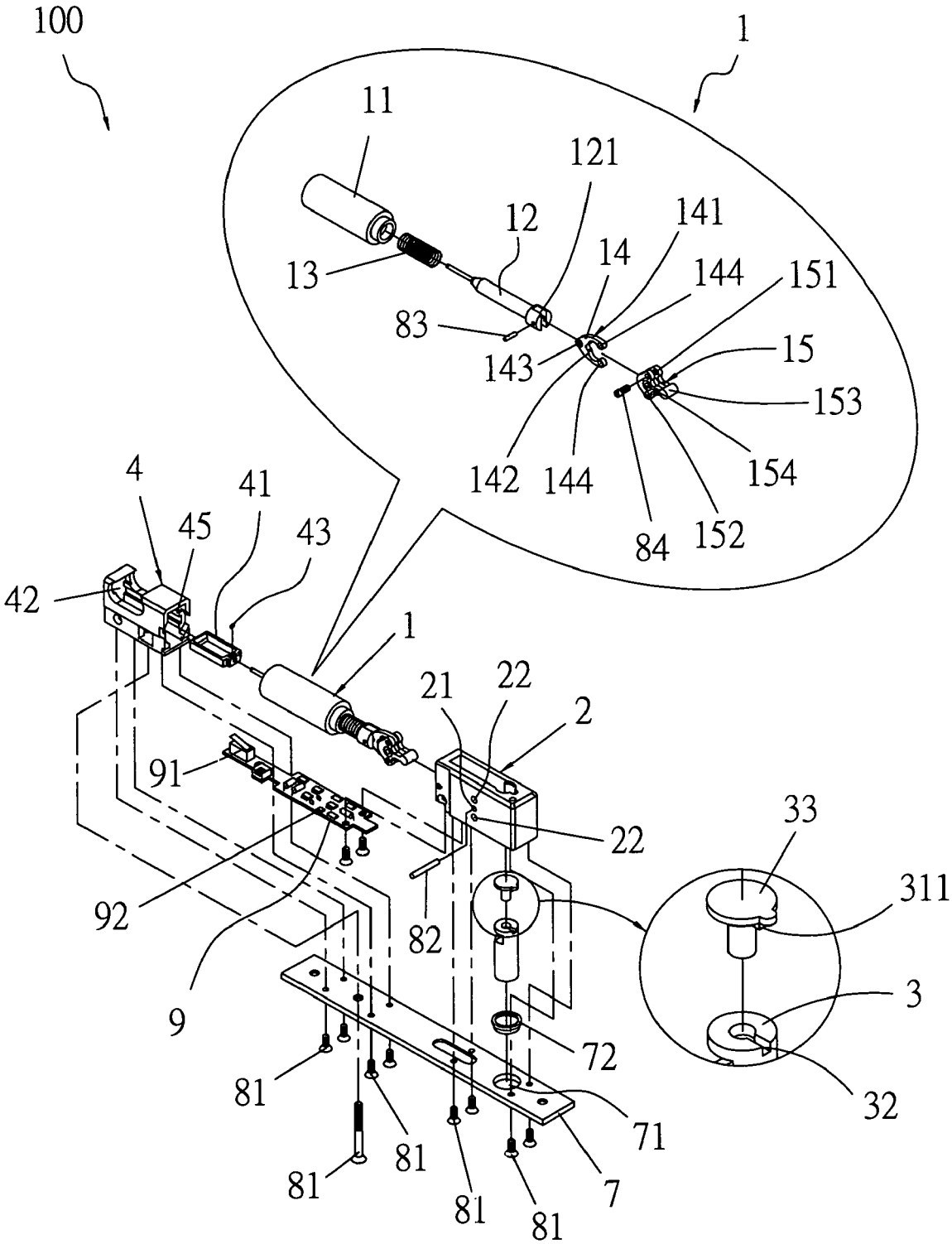
FIG. 1 is an exploded schematic view about the magnetic lock of the present invention.
Figure 2:
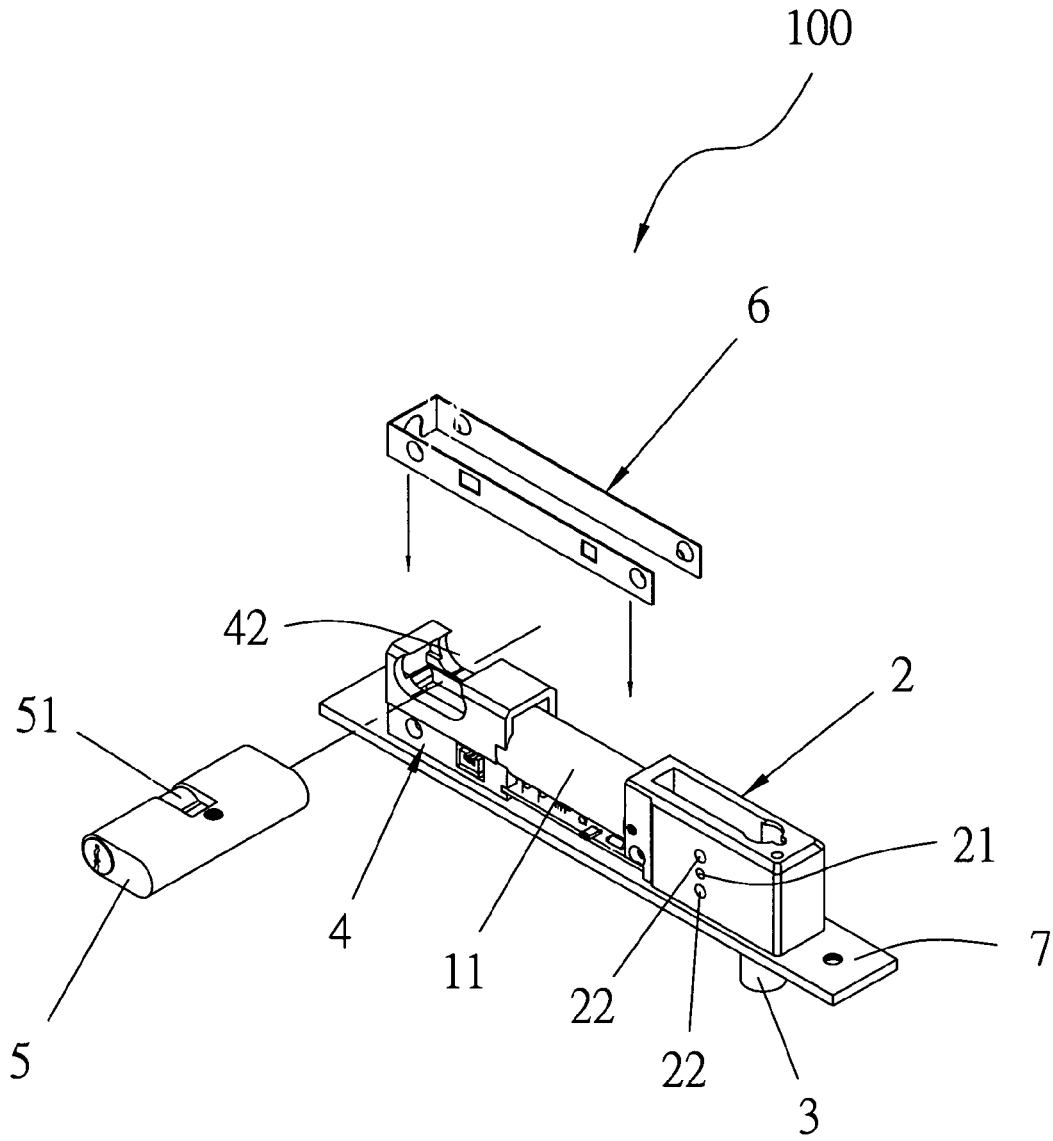
FIG. 2 is a partial exploded schematic view about the magnetic lock of the present invention.
Figure 3:
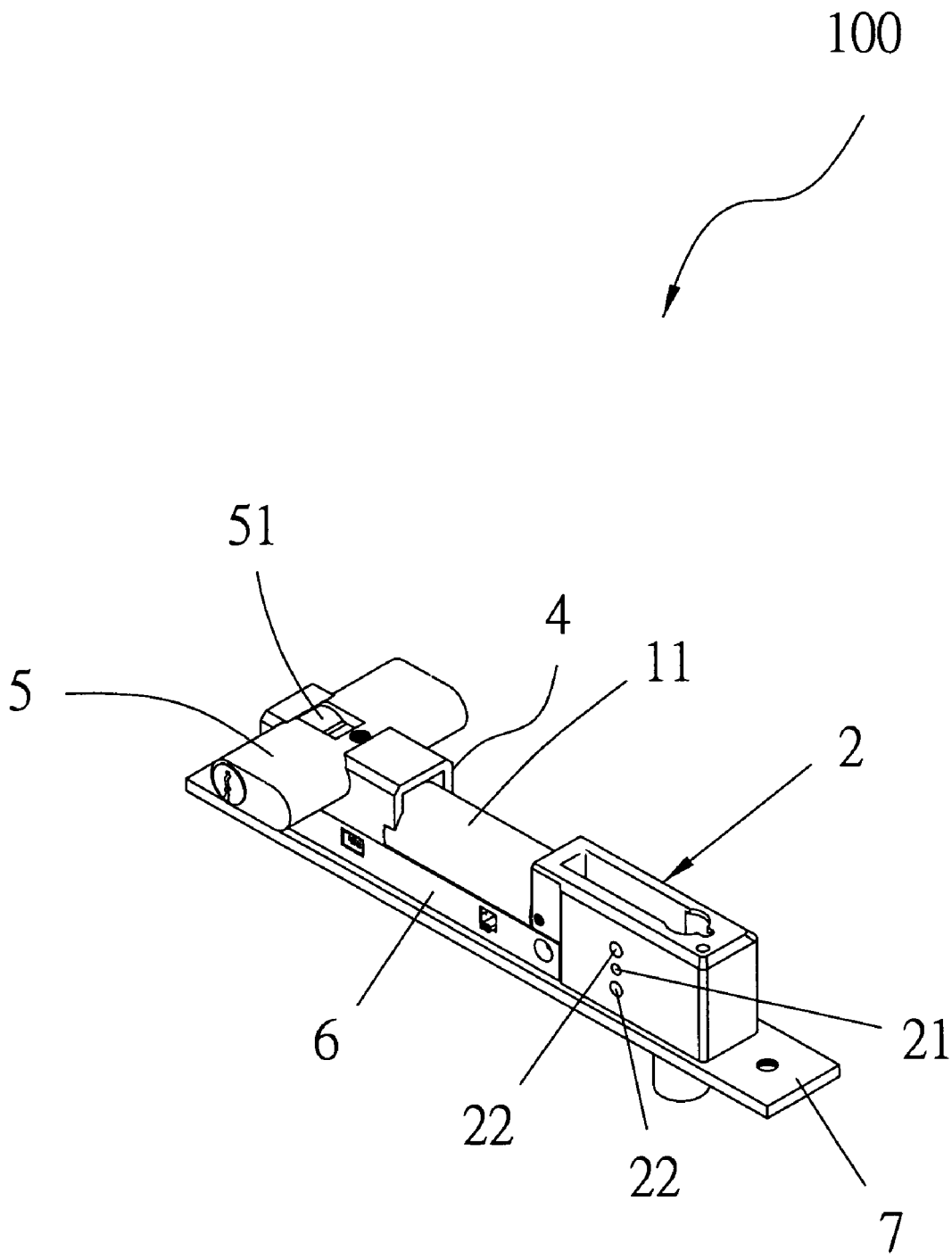
FIG. 3 is a schematic perspective view of the magnetic lock of the present invention.

With reference to FIGS. 1, 2, and 3, the magnetic lock 100 of the present invention is illustrated. The present invention has the following elements.

An actuation portion 1 is formed by a magnetic tube 11, a movable post 12, a spring 13, a driving sheet 14 and a connecting sheet 15. The magnetic tube 11 is received with the movable post 12 therein. A front end of the movable post 12 is engaged to the spring 13. A front end of the movable post 12 is formed with a slot 121 for receiving a retaining hole 143 of the driving sheet 14. The movable post 12 is pivoted to the driving sheet 14 by using the pin 83. The driving sheet 14 is further extended with a first sub-section 141 and a second sub-section 142 which are formed with retaining holes 144, respectively. The first sub-section 141 and the second sub-section 142 are studded to first end 151 and the second end 152 of the connecting sheet 15, respectively. Interiors of the first end 151 and the second end 152 are threaded for screwing the outer threads of the pin 84. The connecting sheet 15 has a retaining hole 154. The connecting sheet 15 further has the third end 153.

A positioning seat 2 has a slot at a rear end thereof for receiving the actuation portion 1 and a circuit board 9. A pin bank seat 92 may be added to the circuit board 9 for switching the opening mode in turning off and turning on. A slot is formed at a lower end of the positioning seat 2. An exterior of the positioning seat 2 is formed with two via holes 22 and a positioning hole 21 for receiving a pin 82. The via holes 22 are corresponding to the retaining holes 144 of the driving sheet 14. The pin 82 and the positioning seat 2 are fixed to the retaining hole 154.

A tongue 3 is embedded at the slot at the lower end of the positioning seat 2 and is fixed to the third end 153 of the connecting sheet 15. The tongue 3 is movable within the positioning seat 2.

A retaining seat 4 has a displace unit 41. When the displace unit 41 passes through a distal end of the movable post 12, the displace unit 41 is clamped in the slot of the movable post 12 by using a retaining ring 43 for preventing the displace unit 41 from falling out as the movable post 12 moves. The movable post 12 is movable in the retaining seat 4. The retaining seat 4 has a slot 42.

A core 5 is embedded into the slot 42 of the retaining seat 4 and to combine with the displace unit 41. Thereby the movable post 12, driving sheet 14, connecting sheet 15 and tongue 3 are interconnected. In the present invention, when the magnetic lock 100 is turned off, it still has the function of a mechanic lock. Since the core 5 is combined to the displace unit 41 which is further fixed to the movable post 12, when a key is used to rotate the core 5, a rotary arm 51 in the core 5 will be driven to rotate so as to move the displace unit 41 to drive the movable post 12. Then a front end of the driving sheet 14, the connecting sheet 15 and the tongue 3 will be driven so as to have the function of opening and closing.

A connecting plate 7 is included. The positioning seat 2 and the retaining seat 4 are locked to the connecting plate 7 by screws 81. The connecting plate 7 has a via hole 71. A buffer ring 72 is installed between the positioning seat 2 and the via hole 71 of the connecting plate 7.

A casing 6 is included.

Figure 4A:
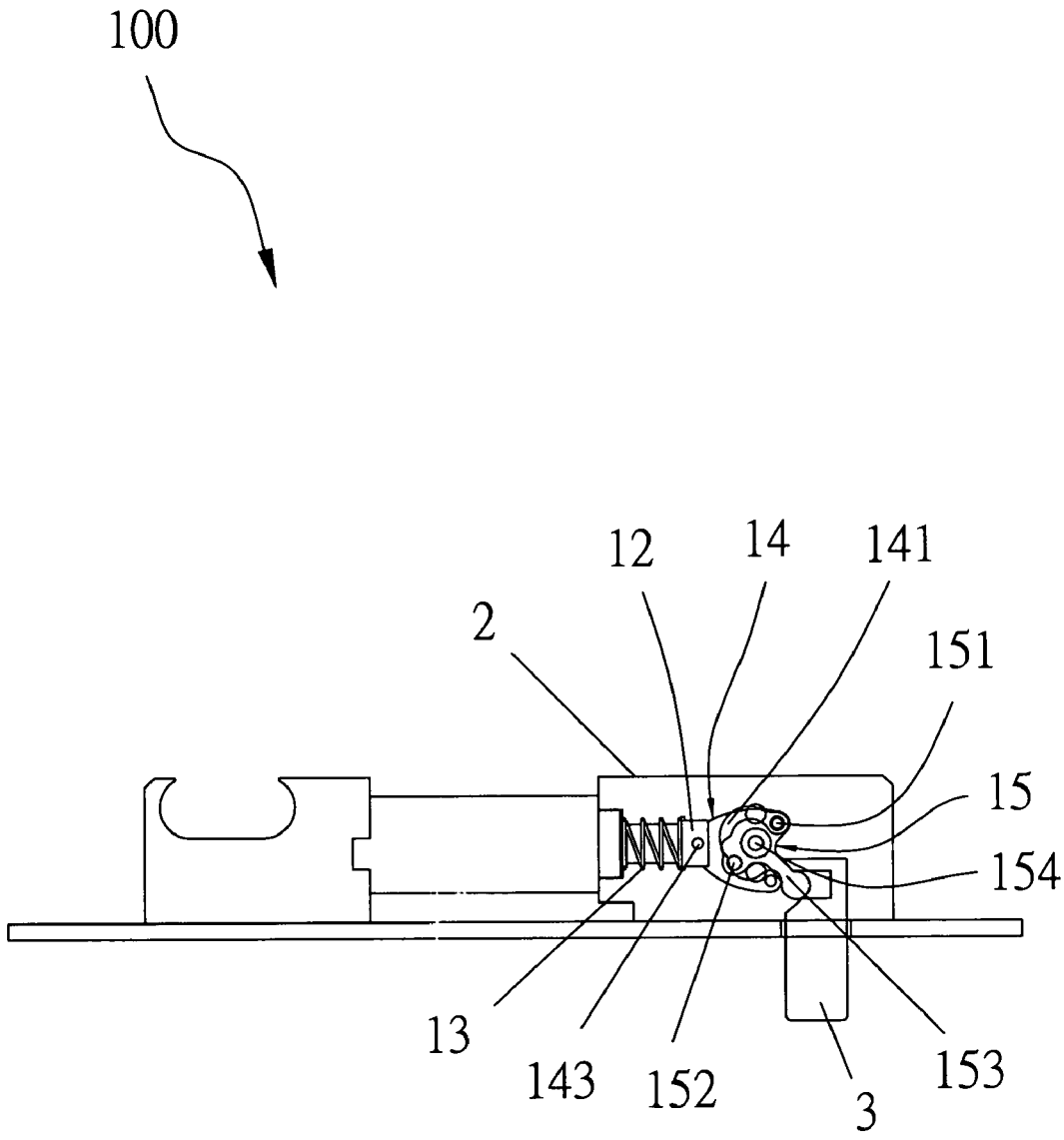
FIGS. 4A and 4B are schematic views showing the open mode when power is on according to the present invention.
Figure 4B:
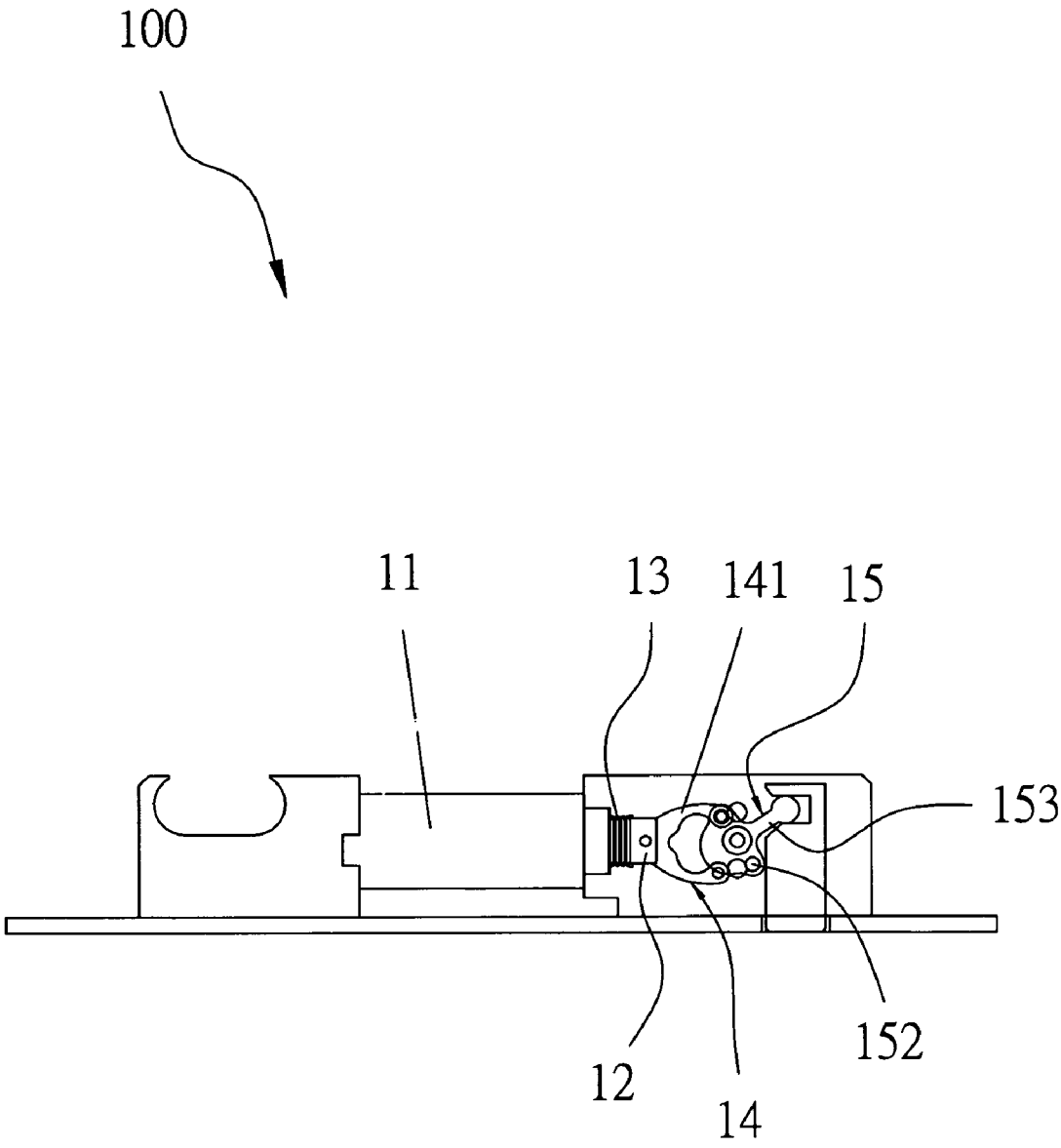

Referring to FIGS. 4A and 4B, a schematic view showing an opening operation when the magnetic lock of the present invention is not turned on. As shown in FIG. 4A, when the magnetic lock 100 is not turned on, the movable post 12 moves forwards and the spring 13 is in a normal state. A front end of the movable post 12 is fixed to the retaining hole 143 of the driving sheet 14. The first sub-section 141 of the driving sheet 14 is pivoted to the first end 151 of the connecting sheet 15 and the retaining hole 154 of the connecting sheet 15 fixes the positioning seat 2. The third end 153 is fixed to the tongue 3. The tongue 3 protrudes out of the positioning seat 2. It is in a lock state. As shown in FIG. 4B, when power is turned on, the magnetic tube 11 will excite the movable post 12 to move backwards and the driving sheet 14 will reduce backwards. Then the spring 13 is compressed. Thus, the first end 151 pivoted to the driving sheet 14 will be pressed downwards. By lever principle, the third end 153 moves, and the tongue 3 reduces inwards into the positioning seat 2 so as to open the lock in turning on state.

Figure 5A:
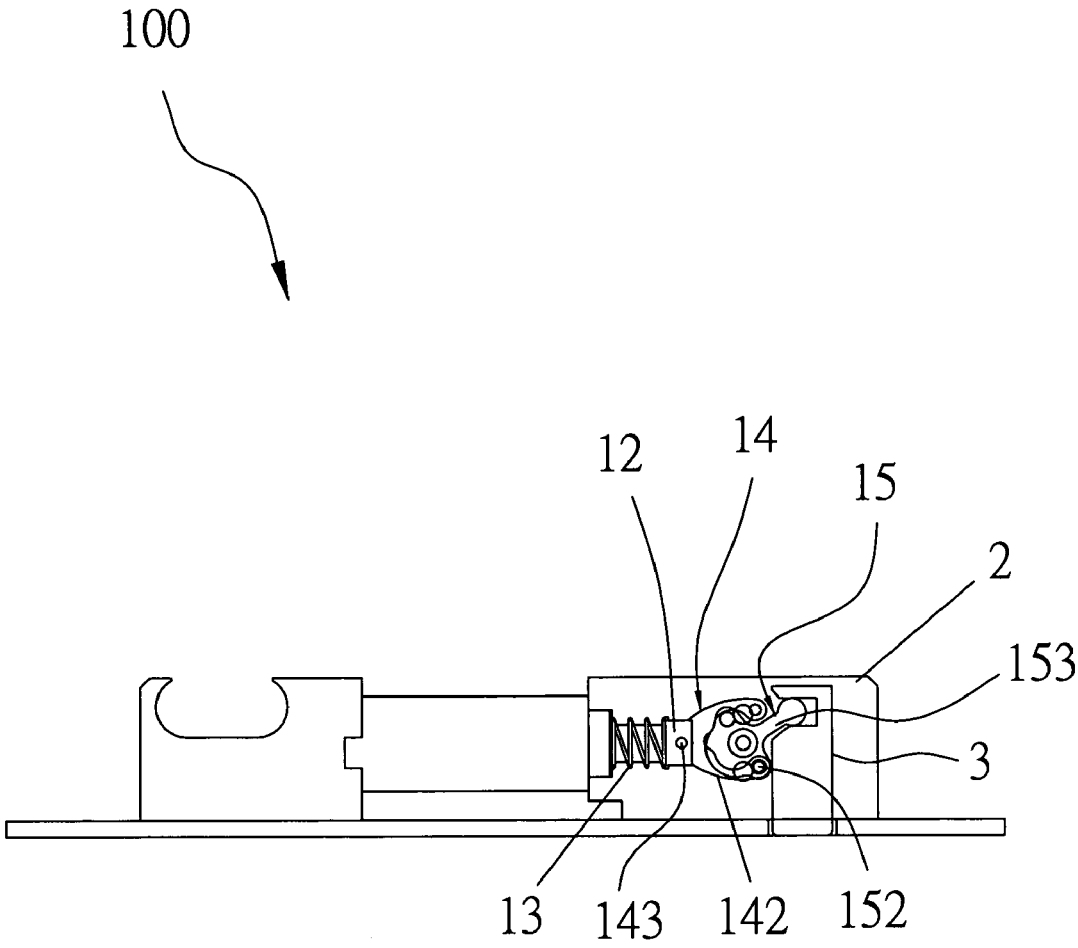
FIGS. 5A and 5B are schematic views showing the close mode when power is on according to the present invention.
Figure 5B:
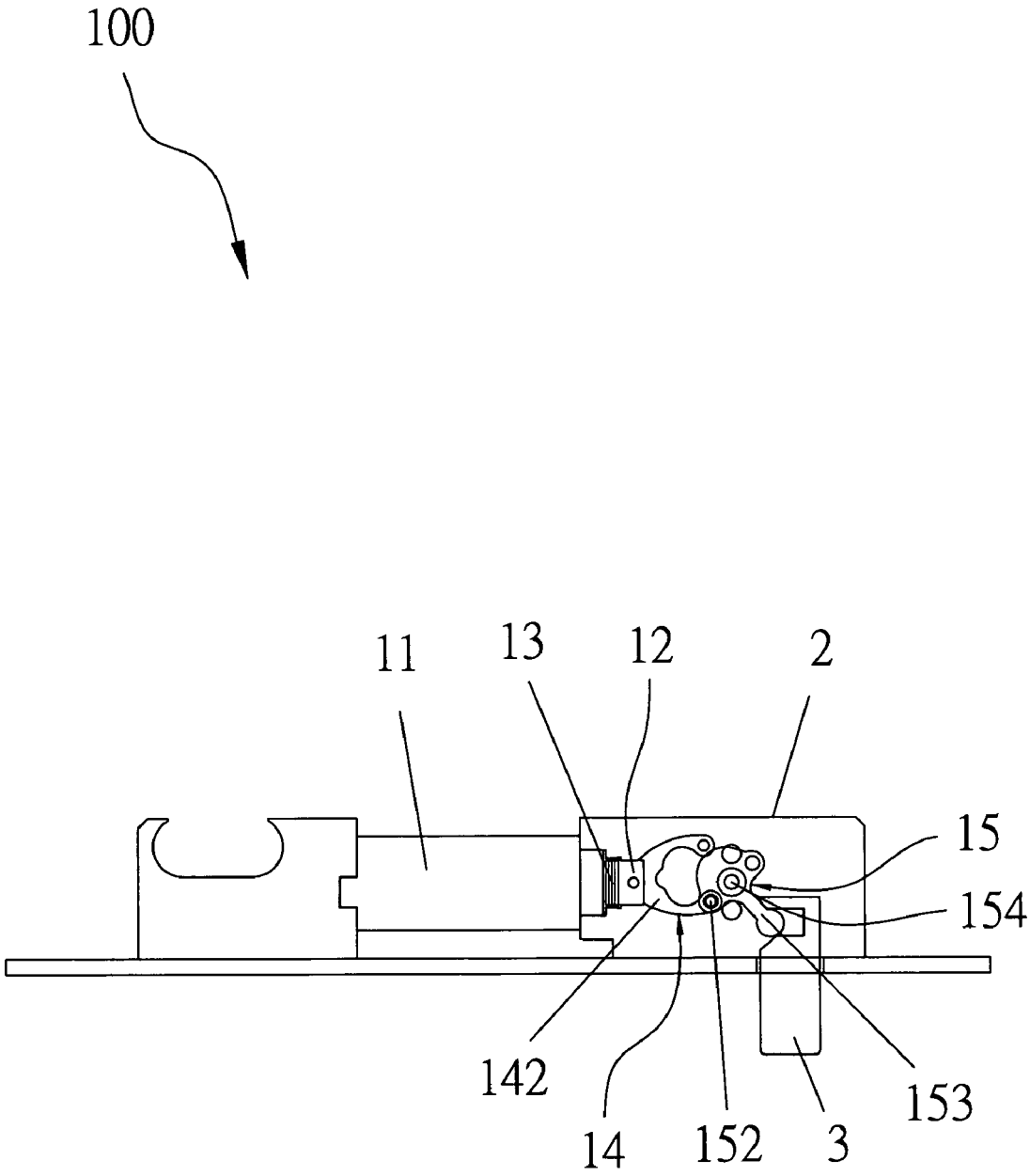

With reference to FIGS. 5A and 5B, schematic views about the closing operation in power on state is illustrated. See FIG. 5A, in the present invention, when power is not turned on, the movable post 12 moves forwards, and the spring 13 is in normal state, a front end of the movable post 12 is pivoted to the retaining hole 143 of the driving sheet 14 and the second sub-section 142 of the driving sheet 14 is pivoted to the second end 152 of the connecting sheet 15. The retaining hole 154 of the connecting sheet 15 is fixed to the positioning seat 2. The third end 153 is fixed to the tongue 3. The tongue 3 reduces inwards into the positioning seat 2. The lock is in the open state. See FIG. 5B, when power is on, the magnetic tube 11 will excite the movable post 12 to move backwards, the driving sheet 14 will reduce backwards. The spring 13 will be compressed. Since the retaining hole 154 of the connecting sheet 15 is fixed, the second end 152 pivoted to the driving sheet 14 will move upwards. By lever principle, the third end 153 moves so that the tongue 3 protrudes out of the positioning seat 2. Thus the lock is in a closing state while the power is on.

In the present invention, the magnetic lock has an open mode as power is on and a close mode as the power is on. In this modes, a pin 84 serves to be inserted into the via hole 22 of the positioning seat 2 so as to be embedded into the retaining hole 143 of the first sub-section 141 or the second sub-section 142 of the driving sheet 14.

Figure 6:
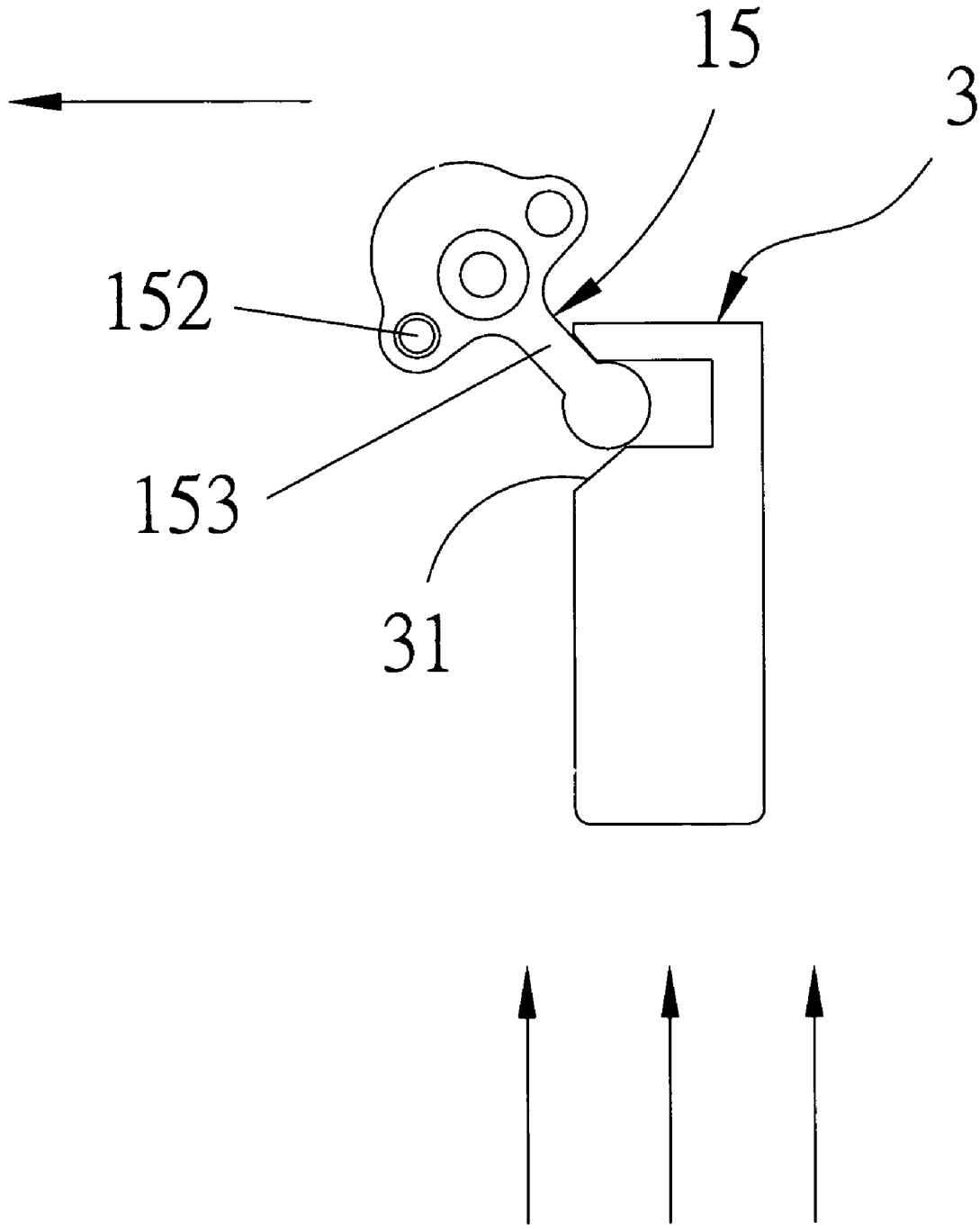
FIG. 6 is an enlarged schematic views about the core of the magnetic lock of the present invention.

Referring to FIG. 6, a schematic view about an improvement of the magnetic lock of the present invention is illustrated. As illustrated in the drawing, a top of the tongue 3 has a positioning cover 33. One lower side of the positioning cover 33 is installed with a block 311 which is buckled to a confining groove 32 of the tongue 3 so as to prevent the core 5 from rotation. The tongue 3 is installed with an inclined surface 31 for preventing the tongue 3 from reducing into the positioning seat 2 when a force is applied to the tongue 3, but when the actuation portion 1 actuates, the reciprocal operation of the tongue 3 will not be affected.

Figure 7A:
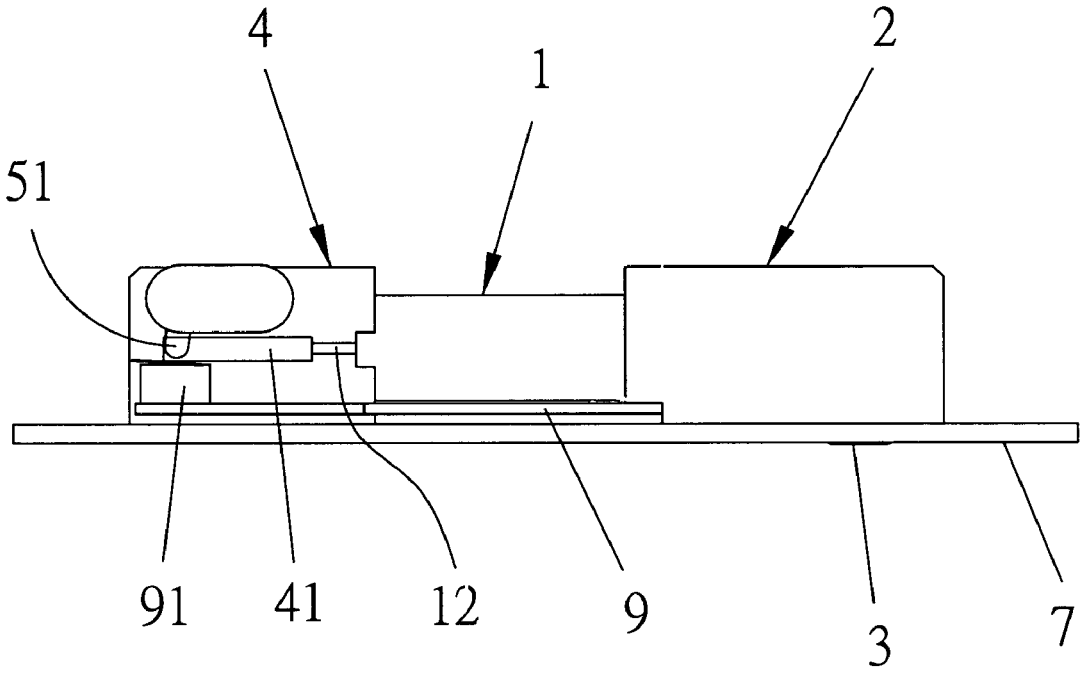
FIGS. 7A and 7B are schematic views showing the operation of the microswitch of the magnetic lock of the present invention.
Figure 7B:
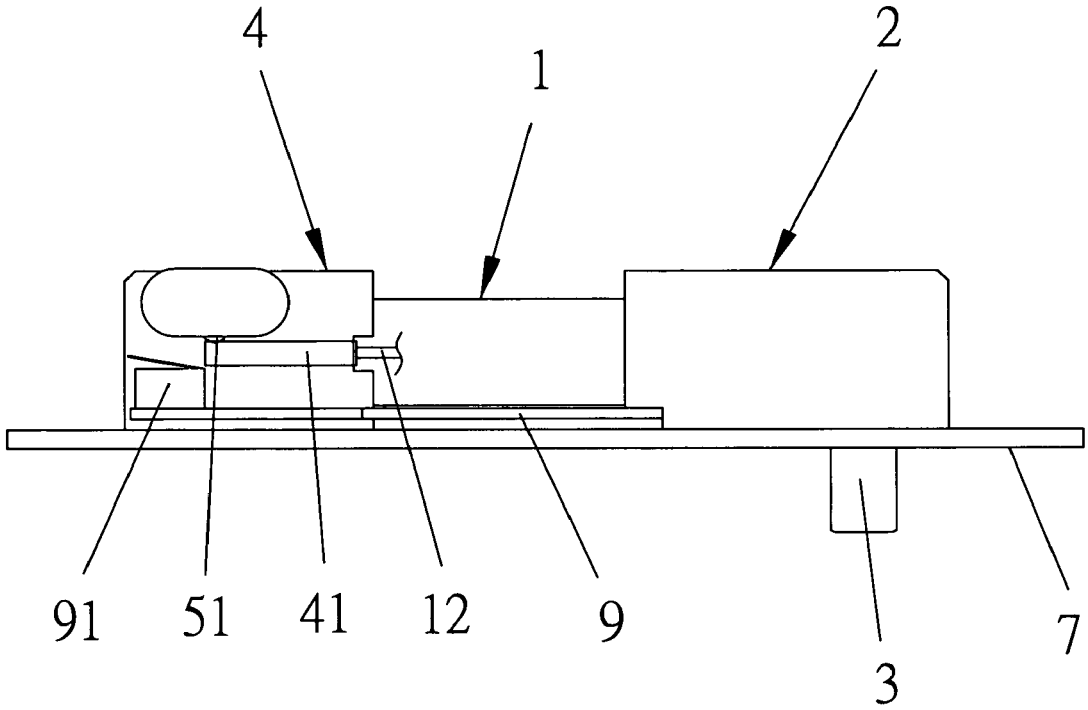

Referring to FIGS. 7A and 7B, when the tongue 3 reduces inwards into the positioning seat 2, the movable post 12 moves backwards. The displace unit 41 is pushed to press a micro switch 91 so as to assure the tongue 3 from protruding out of the positioning seat 2. When the tongue 3 moves outwards to be out of the positioning seat 2, the movable post 12 will drive the displace unit 41 to move forwards so as to release the micro switch 91 to assure the tongue 3 not to reduce into the positioning seat 2. The rotary arm 51 of the core 5 is installed in the displace unit 41. Once the power is tripped, the user will insert the key to rotate the core 5 so that the rotary arm 51 of the core 5 is driven to rotate to make the displace unit 41 to move forwards or backwards to drive the movable post 12 to move. Thus the driving sheet 14, connecting sheet 15 and tongue 3 are driven to achieve the object of manually opening and closing.

Advantages of the present invention will be described herein. The magnetic lock of the present invention is suitable for doors of various specifications. Furthermore, the magnetic lock of the present invention has the open mode in power on the close mode in power off. Moreover, a pin serves to achieve the object of function setting. Furthermore, the magnetic lock of the present invention has the function of mechanical lock and electronic lock. The structure of the magnetic lock is simple and easily in maintenance with a longer lifetime and a lower manufacturing cost.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A magnetic lock comprising:

an actuation portion formed by a magnetic tube, a movable post, a spring, a driving sheet and a connecting sheet; the magnetic tube being received with the movable post therein; a front end of the movable post being engaged to the spring; a front end of the movable post being formed with a slot for receiving a retaining hole of the driving sheet; the movable post being pivoted to the driving sheet by using a pin; the driving sheet being further extended with a first sub-section and the second sub-section which being formed with retaining holes, respectively; the first sub-section and the second sub-section being studded to first end and the second end of the connecting sheet, respectively; interiors of the first end and the second end being threaded for screwing the outer threads of the pin; the connecting sheet having a retaining hole; the connecting sheet further having the third end;

a positioning seat having a slot at a rear end thereof for receiving the actuation portion and a circuit board; a slot being formed at a lower end of the positioning seat; an exterior of the positioning seat being formed with two via holes and a positioning hole for receiving a pin; the via holes being corresponding to the retaining holes of the driving sheet; the positioning seat being fixed to the retaining hole;

a tongue embedded at the slot at the lower end of the positioning seat and being fixed to the third end of the connecting sheet; the tongue being movable within the positioning seat;

a retaining seat having a displace unit; when the displace unit passes through a distal end of the movable post, the displace unit being clamped in the slot of the movable post by using a retaining ring for preventing the displace unit from falling out as the movable post moves; the movable post being movable in the retaining seat; the retaining seat having a slot;

a core embedded into the slot of the retaining seat and to combine with the displace unit; thereby the movable post, driving sheet, connecting sheet and tongue being interconnected;

a connecting plate; the positioning seat and the retaining seat being locked to the connecting plate; the connecting plate having a via hole; and a casing.

2. The magnetic lock as claimed in claim 1, wherein the positioning seat and the retaining seat are locked to the connecting plate by using screws.

3. The magnetic lock as claimed in claim 1, wherein a buffer ring is installed between the positioning seat and the via hole of the connecting plate.

4. The magnetic lock as claimed in claim 1, wherein when the power of the magnetic lock is turned off, since the core is combined to the displace unit, and the displace unit is fixed to the movable post, the core is moved so as to drive the movable post to further drive the driving sheet, connecting sheet and the tongue to achieve the object of opening and closing.

5. The magnetic lock as claimed in claim 1, wherein the magnetic lock has an open mode as power is on and an close mode as power is off; a pin is inserted into a via hole of the positioning seat so as to be embedded into the retaining hole of the first sub-section or the second sub-section to set the modes.

6. The magnetic lock as claimed in claim 1, wherein the tongue is installed with an inclined surface for preventing the tongue from reducing into the positioning seat when a force is applied to the tongue, but when the actuation portion actuates, the reciprocal operation of the tongue will not be affected.

* * * * *